US011665481B2

(12) United States Patent
Ren et al.

(10) Patent No.: US 11,665,481 B2
(45) Date of Patent: May 30, 2023

(54) SPEAKER DEVICE

(71) Applicant: AAC Microtech (Changzhou) Co., Ltd., Changzhou (CN)

(72) Inventors: Zhang Ren, Shenzhen (CN); Zhiwei Zhong, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/563,069

(22) Filed: Dec. 28, 2021

(65) Prior Publication Data

US 2023/0030909 A1 Feb. 2, 2023

(30) Foreign Application Priority Data

Aug. 2, 2021 (CN) ..... 202110880435.X

(51) Int. Cl.
*H04R 9/02* (2006.01)
*H04R 7/18* (2006.01)

(52) U.S. Cl.
CPC ..... *H04R 9/025* (2013.01); *H04R 7/18* (2013.01); *H04R 2400/11* (2013.01); *H04R 2499/11* (2013.01)

(58) Field of Classification Search
CPC ..... H04R 9/025; H04R 7/18; H04R 2400/11; H04R 2499/11
See application file for complete search history.

(56) References Cited

U.S. PATENT DOCUMENTS

2014/0056464 A1* 2/2014 Li ..... H04R 9/025 381/400
2020/0413199 A1* 12/2020 Song ..... H04R 9/06

* cited by examiner

*Primary Examiner* — Sunita Joshi
(74) *Attorney, Agent, or Firm* — W&G Law Group

(57) ABSTRACT

Provided is a speaker device, including a frame; a vibration unit fixed to the frame; and a magnetic circuit unit driving the vibration unit to vibrate and produce sound and including a magnetic gap. The vibration unit includes a diaphragm, a voice coil and an elastic support assembly. The frame includes a bottom wall and a side wall bending and extending from a periphery of the bottom wall of the frame, and an outer periphery of the diaphragm is fixed to the side wall. The vibration unit further includes a fixing ring configured to fix the elastic support assembly to the frame, and the fixing ring surrounds the magnetic circuit unit. The frame is made of a metal material, and the fixing ring is a metal ring fixed to the side wall of the frame by welding. With this structure, overall strength and reliability of the speaker device are improved.

9 Claims, 8 Drawing Sheets

SPEAKER DEVICE

TECHNICAL FIELD

The present disclosure relates to the field of electro-acoustic conversion, in particular to a speaker device for a portable mobile electronic product.

BACKGROUND

Speaker devices are widely used in portable mobile electronic products, such as mobile phones, to convert electrical signals into sound signals. The speaker devices have high volume and desirable low-frequency sound effects.

In the related art, a speaker device includes a frame, a vibration unit fixed to the frame and a magnetic circuit unit driving the vibration unit to vibrate and produce sound. The vibration unit includes a diaphragm fixed to the frame, a voice coil inserted into a magnetic gap to drive the diaphragm to vibrate and produce sound, and an elastic support assembly opposite to and spaced apart from the diaphragm and connected to the voice coil. The elastic support assembly surrounds an outer side of the magnetic circuit unit and are spaced apart from the magnetic circuit unit. For the convenience of assembly, the frame includes a frame body and a frame extension portion stacked on the frame body. The vibration unit is fixed to the frame extension portion, the magnetic circuit unit is fixed to the frame body, and the frame extension portion is installed to the frame body.

In the related art, the elastic support assembly is directly attached and fixed to the frame, and a gluing manner thereof results in low overall strength of the speaker device. Once the speaker device is dropped, the elastic support assembly is prone to be separated from the frame. Therefore, the speaker device having such a structure has low reliability.

Therefore, it needs to provide a speaker device, which solve the above-mentioned technical problem.

SUMMARY

An objective of the present disclosure is to provide a speaker device with high overall strength and reliability.

An embodiment of the present disclosure provides a speaker device, including a frame; a vibration unit fixed to the frame; and a magnetic circuit unit driving the vibration unit to vibrate and produce sound and including a magnetic gap. The vibration unit includes a diaphragm fixed to the frame, a voice coil inserted into the magnetic gap to drive the diaphragm to vibrate and produce sound and at least one elastic support assembly opposite to and spaced apart from the diaphragm and connected to the voice coil; and the at least one elastic support assembly surrounds an outer side of the magnetic circuit unit and is spaced apart from the magnetic circuit unit. The frame includes a bottom wall and a side wall bending and extending from a periphery of the bottom wall of the frame, and an outer periphery of the diaphragm is fixed to the side wall of the frame. The vibration unit further includes a fixing ring configured to fix the at least one elastic support assembly to the frame, and the fixing ring surrounds the magnetic circuit unit. The frame is made of a metal material, and the fixing ring is a metal ring fixed to the side wall of the frame by welding.

As an improvement, the side wall of the frame includes a first side wall connected to the bottom wall of the frame and an extension wall having a ring shape and stacked on the first side wall; the outer periphery of the diaphragm is fixed to an inner peripheral side of the extension wall; and the fixing ring is fixed to the extension wall by welding.

As an improvement, the diaphragm includes a diaphragm fixing portion fixed to the magnetic circuit unit, a dome surrounding the diaphragm fixing portion, and a suspension surrounding the dome; an inner peripheral side of the dome is fixed to a side of the diaphragm fixing portion close to the suspension, and an outer peripheral side of the dome is fixed to a side of the suspension close to the diaphragm fixing portion; the suspension includes a suspension body fixed to the outer peripheral side of the dome, a suspension fixing portion bending and extending from an outer peripheral side of the suspension body toward the inner peripheral side of the extension wall, and suspension supporting portions extending from the suspension fixing portion toward the at least one elastic support assembly along the inner peripheral side of the extension wall; and the suspension fixing portion and the suspension supporting portions are fixed to the inner peripheral side of the extension wall.

As an improvement, the voice coil has a rectangular structure; the at least one elastic support assembly includes two elastic support assemblies, and the two elastic support assemblies are spaced apart from each other and located at two opposite sides of the voice coil; and welding positions of the fixing ring and the extension wall are located between the two elastic support assemblies.

As an improvement, the two elastic support assemblies are respectively located at two opposite sides of a short axis of the voice coil; and the welding positions of the fixing ring and the extension wall are respectively located at two opposite sides of a long axis of the voice coil.

As an improvement, one of the at least one elastic support assembly includes an elastic member opposite to and spaced apart from the diaphragm, and an auxiliary diaphragm provided at a side of the elastic member away from the diaphragm; a side of the elastic member close to the frame is attached to a side of the fixing ring away from the diaphragm, and a side of the elastic member away from the frame is connected to the voice coil; a side of the auxiliary diaphragm close to the frame is attached to a side of the fixing ring away from the diaphragm, and a side of the auxiliary diaphragm away from the frame is connected to the voice coil; and the side of the elastic member away from the frame and the side of the auxiliary diaphragm away from the frame are spaced apart from each other.

As an improvement, the suspension fixing portion has a rectangular structure with rounded corners; the suspension fixing portion includes four straight sides and four round corners, each of which connects respective two adjacent straight sides of the four straight sides; and the suspension supporting portions are located at positions of the four rounded corners and fixed to the extension wall by gluing.

As an improvement, the vibration unit further includes a holder fixed to the diaphragm; and the holder includes an end extending into the magnetic gap and fixed to and connected to the voice coil, and another end extending toward the at least one elastic support assembly and fixed to and connected to the at least one elastic support assembly.

As an improvement, the fixing ring includes a fixing ring body having a ring shape, and a fixing ring fixing portion bending and extending from an inner peripheral side of the fixing ring body in a direction away from the diaphragm; the fixing ring body is fixed to the extension wall by welding; and the fixing ring fixing portion is fixed to the auxiliary diaphragm. The auxiliary diaphragm includes an auxiliary diaphragm suspension, a first auxiliary diaphragm fixing portion bending and extending from an inner side of the auxiliary diaphragm suspension toward the magnetic circuit unit, a first auxiliary diaphragm extension portion extending from the first auxiliary diaphragm fixing portion toward the diaphragm, a second auxiliary diaphragm fixing portion bending and extending from an outer side of the auxiliary diaphragm suspension toward the frame, and a second auxiliary diaphragm extension portion extending from the second auxiliary diaphragm fixing portion toward the diaphragm. The first auxiliary diaphragm fixing portion is fixed to an end of the holder away from the diaphragm, and the first auxiliary diaphragm extension portion is attached and fixed to a side of the holder close to the frame. The second auxiliary diaphragm fixing portion is fixed to a side of the fixing ring fixing portion away from the diaphragm; an inner side of the second auxiliary diaphragm extension portion is attached and fixed to an outer side of the fixing ring fixing portion; and a side of the second auxiliary diaphragm extension portion close to the diaphragm abuts against and is fixed to a side of the fixing ring body away from the diaphragm. The elastic members includes a first fixing arm fixed to a side of the fixing ring body close to the diaphragm, a second fixing arm fixed to the holder, and an elastic arm connecting the first fixing arm and the second fixing arm; and the second fixing arm is spaced apart from the auxiliary diaphragm.

As an improvement, the holder includes a holder body having a ring shape, a first holder fixing portion bending and extending from an inner peripheral side of the holder body toward the voice coil, and a second holder fixing portion bending and extending from an outer peripheral side of the holder body toward the at least one elastic support assembly; the holder body is fixed to the suspension body; and the first holder fixing portion is fixed to and connected to the voice coil; and the first auxiliary diaphragm fixing portion is fixed to the second holder fixing portion, and the first auxiliary diaphragm extension portion is fixed to a side of the second holder fixing portion close to the frame; the second holder fixing portion includes a holder hole; and the second fixing arm passes through the holder hole to be fixed to the second holder fixing portion.

Compared with the related art, in the present disclosure, the frame is made of a metal material, the fixing ring is a metal ring, and the fixing ring is fixed to the side wall by welding and thus fixes the elastic support assembly to the frame. With this simple structure, the elastic support assembly and the fixing ring can easily be fixed to the frame. There is no need to separately design a structural support feature on the fixing ring or the frame to add a part or process step, which simplifies the assembly process of the speaker device. In addition, the elastic support assembly, the fixing ring and the frame of the speaker device form a firm overall structure. This structure enhances the stability of the vibration unit to deal with the dropping of the speaker device, thereby improving the overall strength and reliability of the speaker device.

BRIEF DESCRIPTION OF DRAWINGS

To describe the technical solutions in the embodiments of the present disclosure more clearly, the drawings required for describing the embodiments are briefly described below. Apparently, the drawings in the following description show merely some embodiments of the present disclosure, and those of ordinary skill in the art may still derive other drawings from these drawings without creative efforts.

DETAILED DESCRIPTION OF EMBODIMENTS

The technical solutions of the embodiments of the present disclosure are described in detail below with reference to the drawings. Apparently, the described embodiments are merely some rather than all of the embodiments of the present disclosure. All other embodiments obtained by those of ordinary skill in the art based on the embodiments of the present disclosure without creative efforts should fall within the protection scope of the present disclosure.

Figure 1:
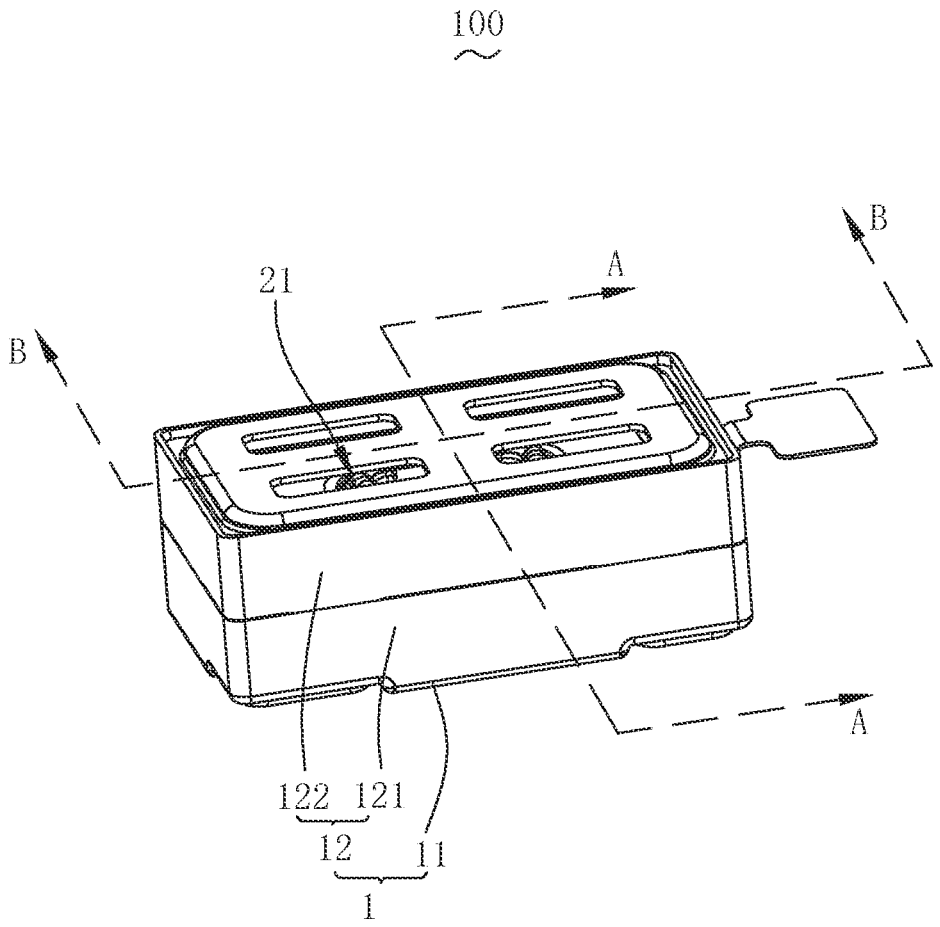
FIG. 1 is a three-dimensional view illustrating a structure of a speaker device according to an embodiment of the present disclosure.
Figure 2:
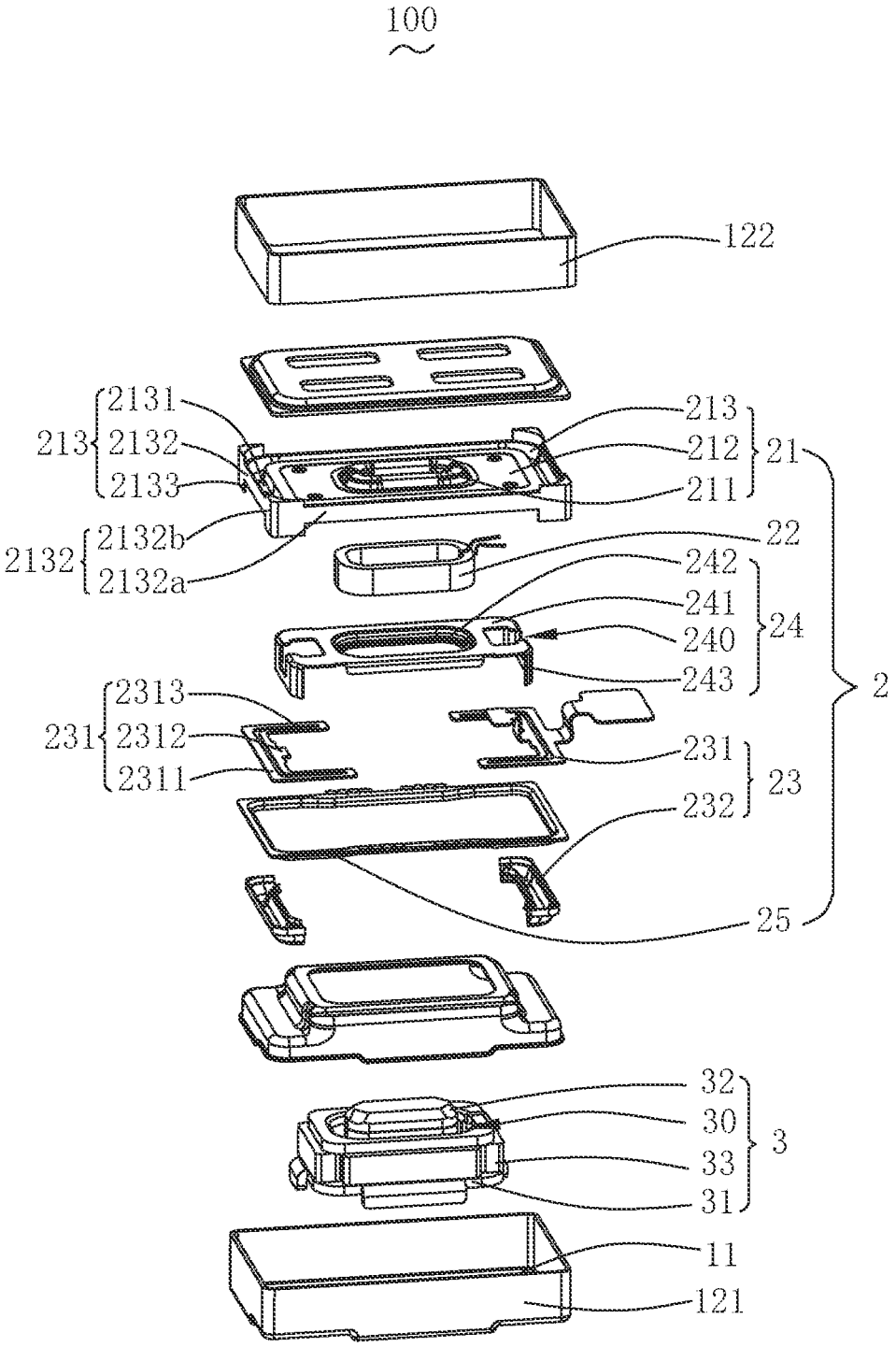
FIG. 2 is a three-dimensional exploded view illustrating a structure of a speaker device according to an embodiment of the present disclosure.
Figure 3:
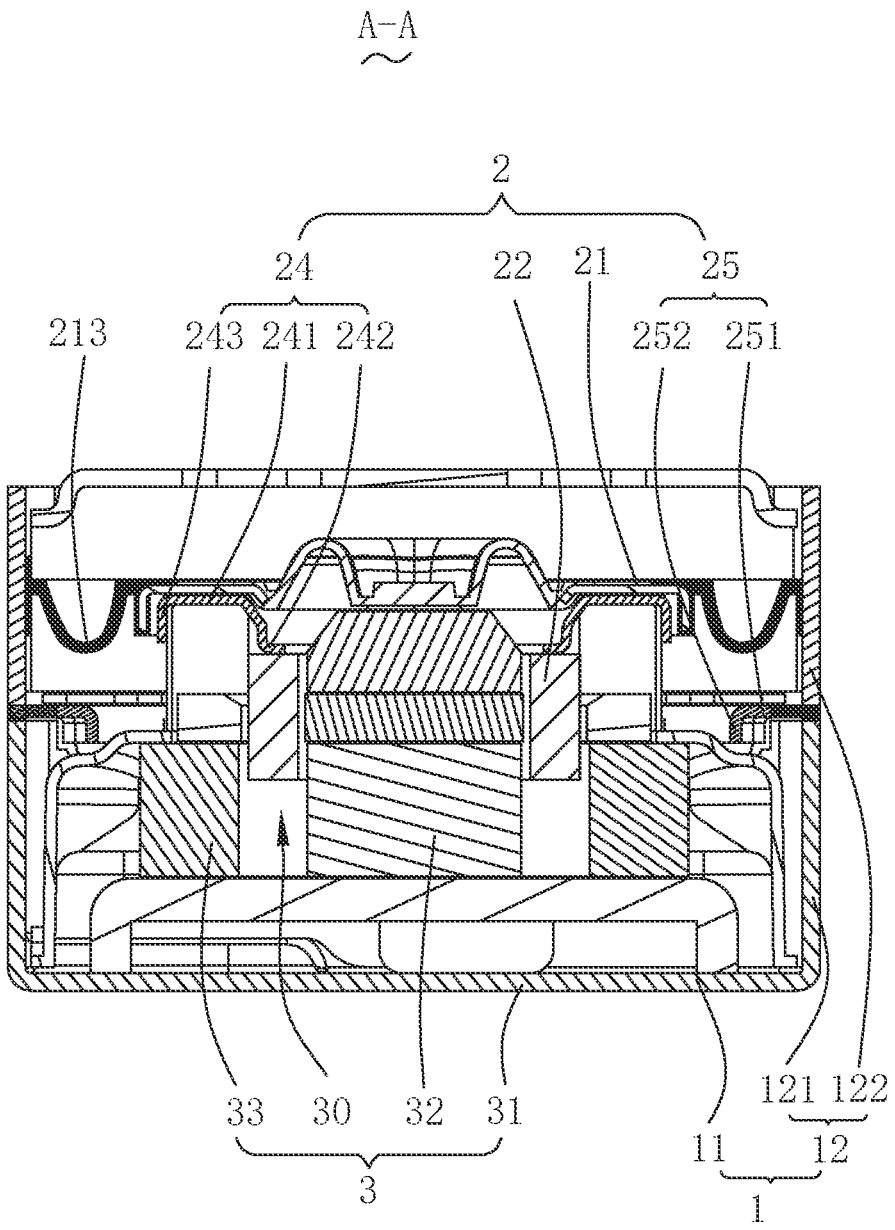
FIG. 3 is a sectional view taken along line A-A in FIG. 1.
Figure 4:
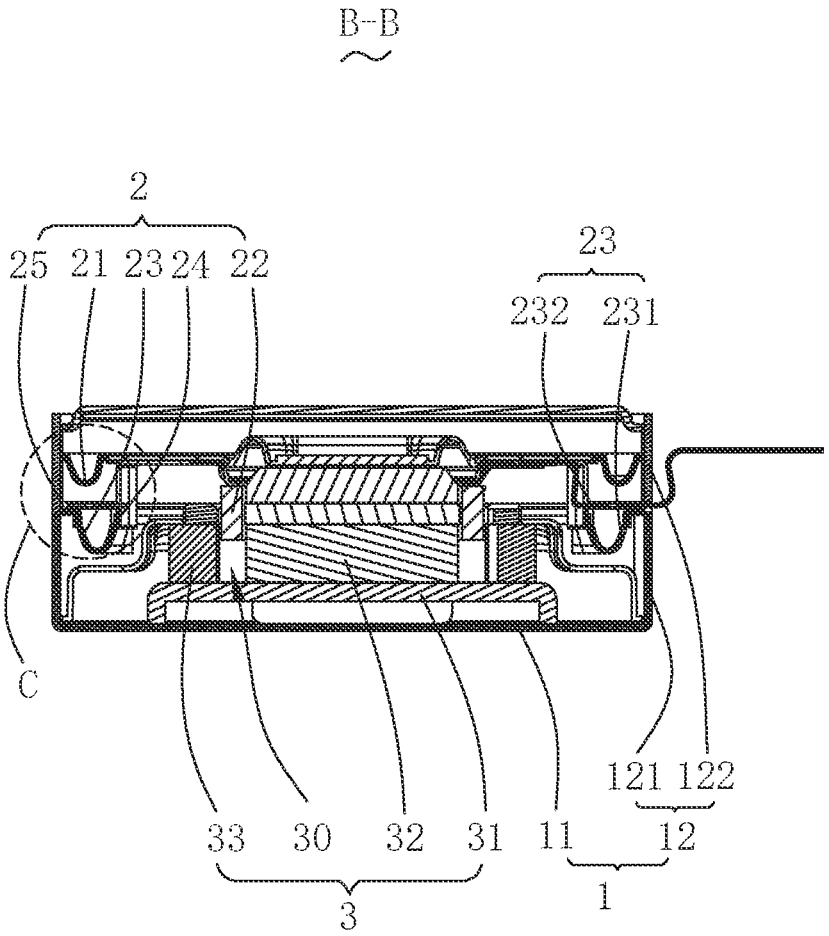
FIG. 4 is a sectional view taken along line B-B in FIG. 1.
Figure 5:
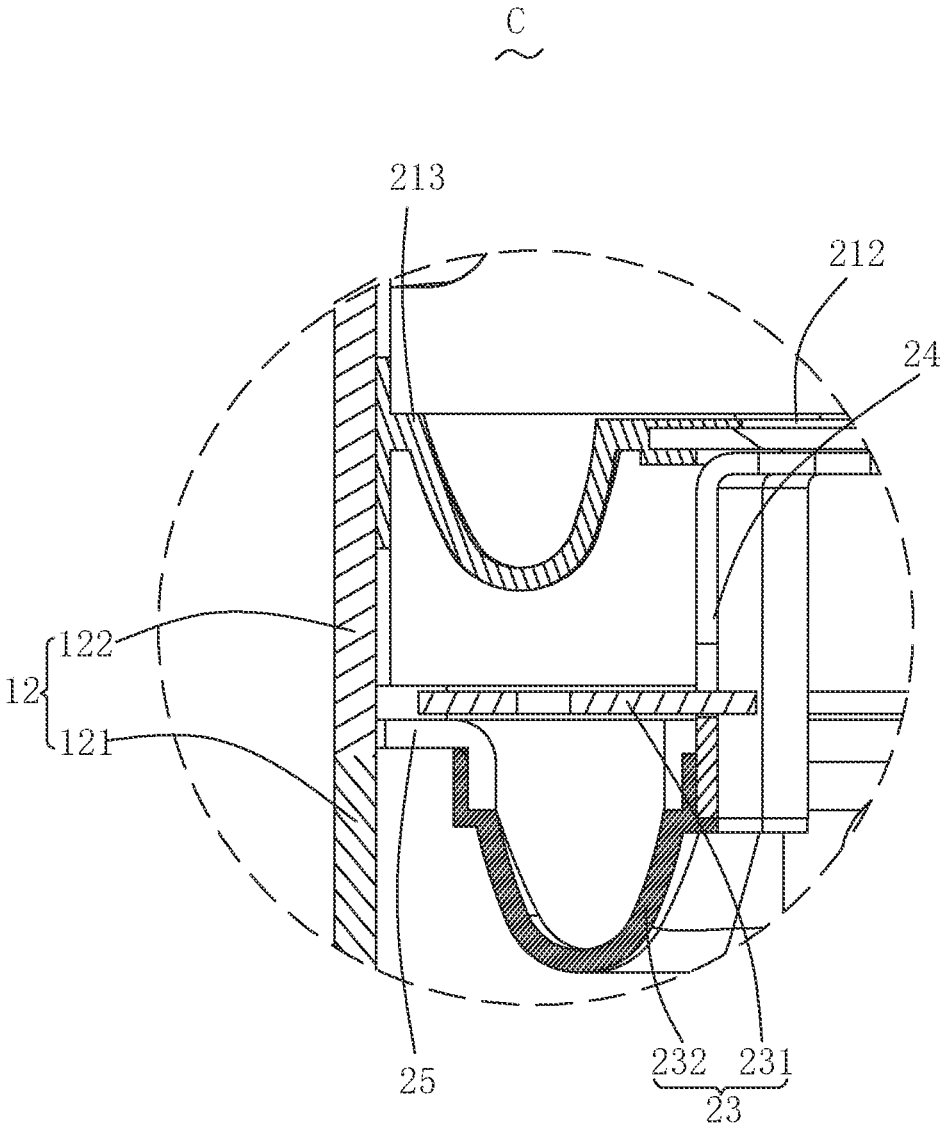
FIG. 5 is an enlarged view of C shown in FIG. 4.
Figure 6:
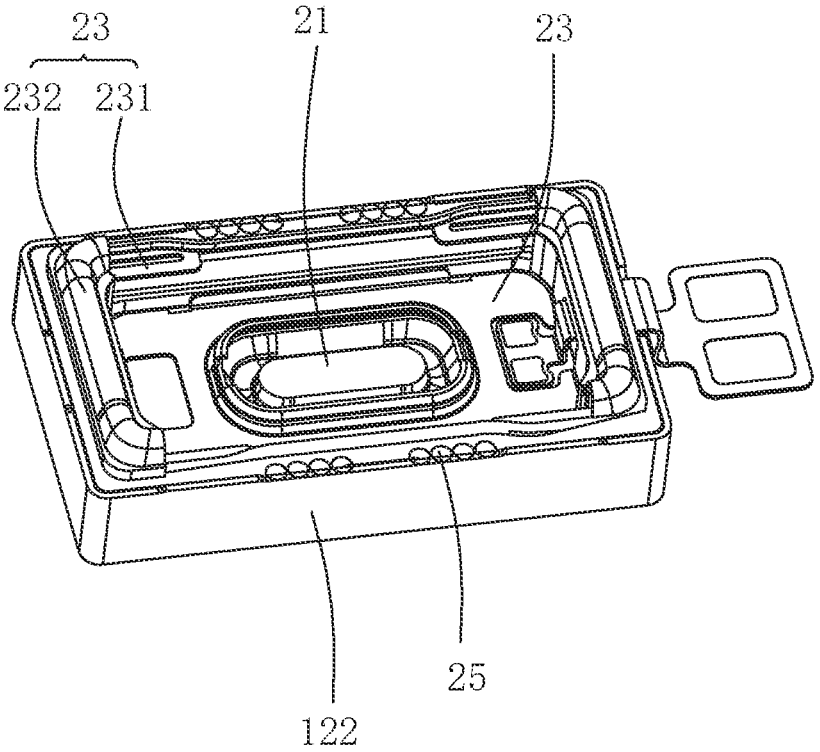
FIG. 6 is a three-dimensional view illustrating a structure of a speaker device after assembly according to an embodiment of the present disclosure.
Figure 7:
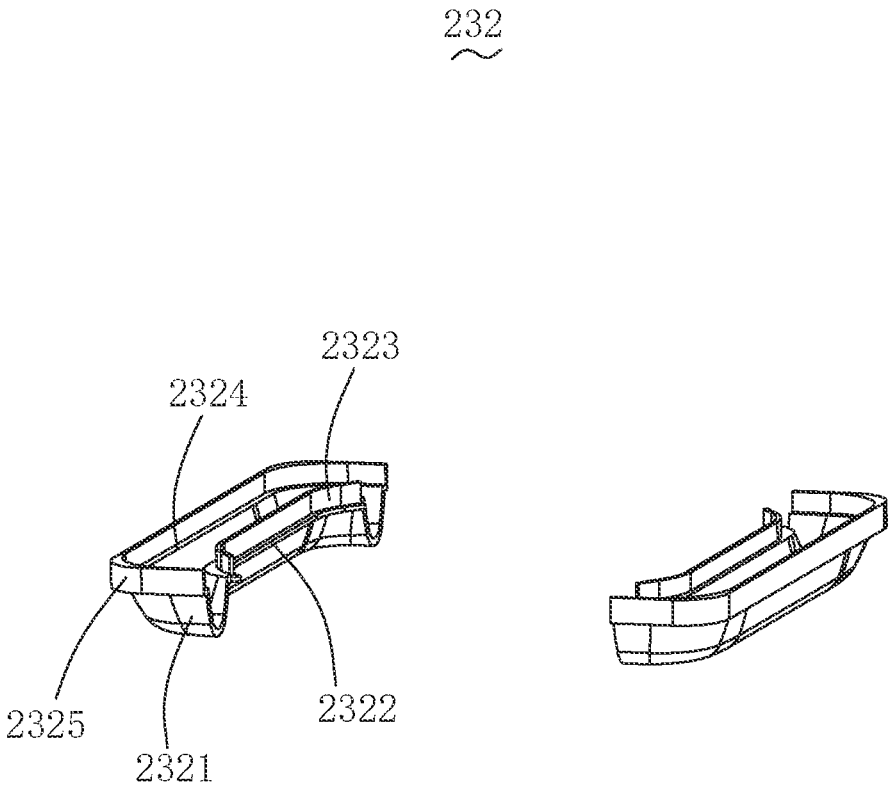
FIG. 7 is a three-dimensional view illustrating a structure of auxiliary diaphragms of a speaker device according to an embodiment of the present disclosure.
Figure 8:
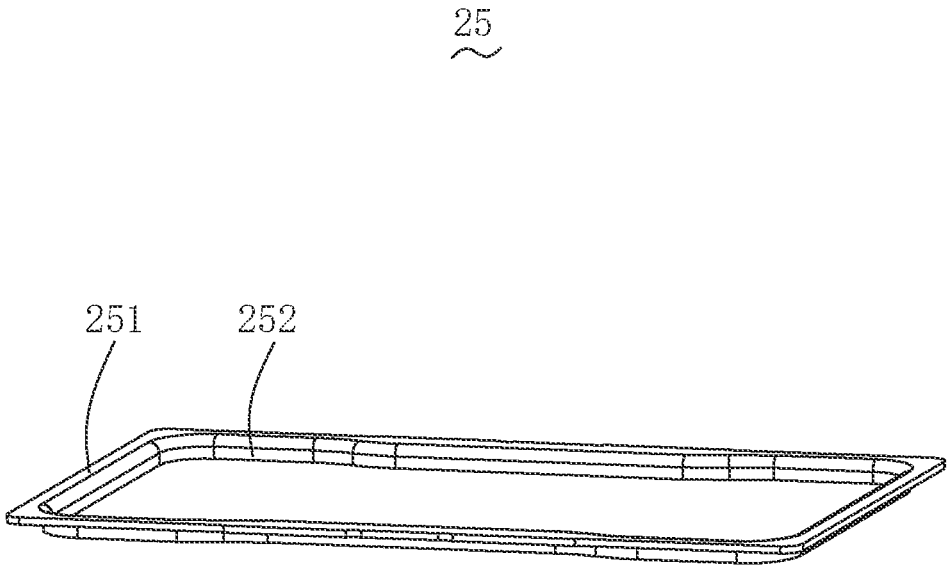
FIG. 8 is a three-dimensional view illustrating a structure a fixing ring of a speaker device according to an embodiment of the present disclosure.

Referring to FIG. 1 to FIG. 8, the present disclosure provides a speaker device 100.

The speaker device 100 includes a frame 1, a vibration unit 2 fixed to the frame 1 and a magnetic circuit unit 3 driving the vibration unit 2 to vibrate and produce sound. The magnetic circuit unit 3 includes a magnetic gap 30.

The frame 1 is ring-shaped. The frame 1 includes a bottom wall 11 and a side wall 12 bending and extending from a periphery of the bottom wall 11.

In this implementation, the magnetic circuit unit 3 is fixed to the bottom wall 11. In other implementation, the magnetic circuit unit 3 may be fixed to an inner peripheral side of the side wall 12.

The side wall 12 may be formed as an integral structure. In this implementation, the side wall 12 is a structure including separated parts. Specifically, the side wall 12 includes a first side wall 121 connected to the bottom wall 11 and a ring-shaped extension wall 122 stacked on the first side wall 121. Such a structure facilitates assembly and manufacture of the speaker device 100.

The vibration unit 2 includes a diaphragm 21 fixed to the frame 1, a voice coil 22 inserted into the magnetic gap 30 to drive the diaphragm 21 to vibrate and produce sound, an elastic support assembly 23 opposite to and spaced apart from the diaphragm 21 and connected to the voice coil 22, a holder 24 fixed to the diaphragm 21, and a fixing ring 25 configured to fix the elastic support assembly 23 to the frame 1. The fixing ring 25 surrounds the magnetic circuit unit 3.

In this implementation, an outer periphery of the diaphragm 21 is fixed to an inner peripheral side of the side wall 12. In other words, the outer periphery of the diaphragm 21 is fixed to the first side wall 121 through the extension wall 122.

Specifically, the diaphragm 21 includes a diaphragm fixing portion 211 fixed to the magnetic circuit unit 3, a dome 212 surrounding the diaphragm fixing portion 211, and a suspension 213 surrounding the dome 212.

The diaphragm fixing portion 211 is configured to fix the diaphragm to the magnetic circuit unit 3. In this implementation, the diaphragm fixing portion 211 is fixed to and covers the magnetic circuit unit 3. In other implementation, the diaphragm fixing portion 211 may be ring-shaped, and the diaphragm fixing portion 211 is fixed to and surrounds the magnetic circuit unit 3.

The dome 212 is ring-shaped. The dome 212 is configured to enable the diaphragm 21 to vibrate and produce sound. Specifically, an inner peripheral side of the dome 212 is fixed to a side of the diaphragm fixing portion 211 close to the suspension 213, and an outer peripheral side of the dome 212 is fixed to a side of the suspension 213 close to the diaphragm fixing portion 211.

The suspension 213 includes a suspension body 2131 fixed to the outer peripheral side of the dome 212, a suspension fixing portion 2132 bending and extending from an outer peripheral side of the suspension body 2131 toward an inner peripheral side of the extension wall 122, and suspension supporting portions 2133 extending from the suspension fixing portion 2132 toward the elastic support assembly 23 along the inner peripheral side of the extension wall 122.

The suspension fixing portion 2132 is attached and fixed to the inner peripheral side of the extension wall 122. In this implementation, the suspension fixing portion 2132 extends from the outer peripheral side of the suspension body 211 along the inner peripheral side of the extension wall 122 in a direction away from the elastic support assembly 23. With this structure, a bonding area of the suspension fixing portion 2132 and the frame 1 is increased, thereby obtaining a strong fixing effect, and thus improving the overall strength and reliability of the speaker device 100.

The suspension supporting portions 2133 are fixed to a side of the elastic support assembly 23 away from the bottom wall 11. The suspension supporting portions 2133 are configured to fix the elastic support assembly 23 to the frame 1. The suspension supporting portions 2133 extends from the suspension fixing portion 2132 toward the elastic support assembly 23 along the inner peripheral side of the extension wall 122. The suspension supporting portions 2133 are fixed to the inner peripheral side of the extension wall 122. With this structure, the bonding area of the suspension supporting portions 2133 and the frame 1 is increased, thereby improving the overall strength and reliability of the speaker device 100. This structure also facilitates assembly and manufacture of the speaker device 100.

Optionally, the suspension fixing portion 2132 has a rectangular structure having rounded corners 2132*b*. The suspension fixing portion 2132 includes four straight sides 2132*a* and four round corners 2132*b* respectively connecting two adjacent straight sides 2132*a* of the four straight sides 2132*a*. The suspension supporting portions 2133 are respectively located at positions of the rounded corners 2132*b*. In other words, the suspension supporting portions 2133 are formed by extending the rounded corners 2132*b* of the suspension fixing portion 2132. In this structure, the space of the diaphragm 21 and the frame 1 at positions of the rounded corners 2132*b* can be fully utilized, thereby increasing the bonding area between the suspension supporting portions 2133 and the frame 1. In this way, the stability of the vibration unit 2 is enhanced to deal with the dropping of the speaker device 100, thereby improving the overall strength and reliability of the speaker device 100.

In this implementation, the suspension supporting portions 2133 are fixed to the extension wall 122 by gluing. Such a structure facilitates fixing and sealing between the diaphragm 21 and the frame 1, thereby improving the overall strength and reliability of the speaker device 100.

The voice coil 22 is inserted and suspended in the magnetic gap 30 to drive the diaphragm 21 to produce sound.

The elastic support assembly 23 is provided between the bottom wall 11 and the diaphragm 21. Specifically, the elastic support assembly 23 surrounds an outer side of the magnetic circuit unit 3 and is spaced apart from the magnetic circuit unit 3. The elastic support assembly 23 strengthens the vibration effect of the diaphragm 21 so as to improve the acoustic performance of the speaker device 100, and also balances the swing of the vibration unit 2 so as to improve the stability of the speaker device 100.

Specifically, the elastic support assembly 23 includes an elastic member 231 opposite to and spaced apart from the diaphragm 21, and an auxiliary diaphragm 232 provided at a side of the elastic member 231 away from the diaphragm 21.

The elastic member 231 includes a first fixing arm 2311 fixed to a side of a fixing ring body 251 close to the diaphragm 21, a second fixing arm 2312 fixed to the holder 24, and an elastic arm 2313 connecting the first fixing arm 2311 and the second fixing arm 2312. The second fixing arm 2312 is spaced apart from the auxiliary diaphragm 232.

In this implementation, the elastic member 231 is a flexible printed circuit (FPC) electrically connected to the voice coil 22. The elastic member 231 also serves to provide an electrical signal for a lead wire of the voice coil 22, thereby avoiding the use of a lead wire structure to introduce the electrical signal to the voice coil 22. Therefore, a risk of wire breakage is avoided, and the reliability of the speaker device 100 is improved.

The auxiliary diaphragm 232 includes an auxiliary diaphragm suspension 2321, a first auxiliary diaphragm fixing portion 2322 bending and extending from an inner side of the auxiliary diaphragm suspension 2321 toward the magnetic circuit unit 3, a first auxiliary diaphragm extension portion 2323 extending from the first auxiliary diaphragm fixing portion 2322 toward the diaphragm 21, a second auxiliary diaphragm fixing portion 2324 bending and extending from an outer side of the auxiliary diaphragm suspension 2321 toward the frame 1, and a second auxiliary diaphragm extension portion 2325 extending from the second auxiliary diaphragm fixing portion 2324 toward the diaphragm 21.

In this implementation, the fixing ring 25 includes the ring-shaped fixing ring body 251 and a fixing ring fixing portion 252 bending and extending from an inner peripheral side of the fixing ring body 251 in a direction away from the diaphragm 21.

The frame 1 is made of a metal material, and the fixing ring 25 is a metal ring. The fixing ring 25 is fixed to the side wall 12 by welding. Specifically, the fixing ring body 251 is fixed to the extension wall 122 by welding. With this simple structure, the elastic support assembly 23 and the fixing ring 25 can easily be fixed to the frame, and there is no need to separately design a structural support feature on the fixing ring or the frame to add a part or process step, which simplifies the assembly process of the speaker device 100; moreover, the elastic support assembly 23, the fixing ring 25 and the frame 1 of the speaker device 100 can form a firm overall structure. This structure enhances the stability of the vibration unit 2 to deal with the dropping of the speaker device 100, thereby improving the overall strength and reliability of the speaker device 100.

The fixing ring fixing portion 252 is fixed to the auxiliary diaphragm 232.

In this implementation, the voice coil 22 has a rectangular structure. Two elastic support assemblies 23 are provided, and the two elastic support assemblies 23 are spaced apart at two opposite sides of the voice coil 22. Welding positions of the fixing ring 25 and the extension wall 122 are located between the two elastic support assemblies 23. The welding positions facilitate the assembly of the speaker device 100 without affecting the fixing positions of the elastic support assemblies 23 and the fixing ring 25. The welding positions of the fixing ring 25 and the extension wall 122 facilitate assembly and prevent damage to the elastic support assemblies 23 during welding. The fixing ring 25 enhances the overall strength of the frame 1 and improves the reliability of the speaker device 100.

Optionally, the two elastic support assemblies 23 are respectively located at two opposite sides of a short axis of the voice coil 22. The welding positions of the fixing ring 25 and the extension wall 122 are respectively located at two opposite sides of a long axis of the voice coil 22. This structure adopts a symmetrical welding method to improve the overall strength of the fixing ring 25 and the frame 1, thereby improving the reliability of the speaker device 100.

A side of the elastic member 231 close to the frame 1 is attached to a side of the fixing ring 25 away from the diaphragm 21, and a side of the elastic member 231 away from the frame 1 is connected to the voice coil 22. A side of the auxiliary diaphragm 232 close to the frame 1 is attached to a side of the fixing ring 25 away from the diaphragm 21, and a side of the auxiliary diaphragm 232 away from the frame 1 is connected to the voice coil 22. With this structure, the side of the elastic member away from the frame and the side of the auxiliary diaphragm away from the frame are spaced apart from each other. A side of the elastic member 231 close to the frame 1 and a side of the auxiliary diaphragm 232 close to the frame 1 are attached to two opposite sides of the fixing ring 25, respectively. A side of the elastic member 231 away from the frame 1 and a side of the auxiliary diaphragm 232 away from the frame 1 are spaced apart from each other and are connected to the voice coil 22. In other words, the fixing ring 25 is sandwiched between an outer side of the elastic member 231 and an outer side of the auxiliary diaphragm 232. A side of the holder 24 away from the magnetic circuit unit 3 is sandwiched between an inner side of the elastic member 231 and an inner side of the auxiliary diaphragm 232.

Specifically, one side of the elastic member 231 is fixed to a side of the fixing ring body 251 close to the diaphragm 21, and another side of the elastic member 231 is fixed to the holder 24 and is spaced apart from the auxiliary diaphragm 232. The first auxiliary diaphragm fixing portion 2322 is fixed to an end of the holder 24 away from the diaphragm 21, and the first auxiliary diaphragm extension portion 2323 is attached and fixed to a side of the holder 24 close to the frame 1. The second auxiliary diaphragm fixing portion 2324 is fixed to a side of the fixing ring fixing portion 252 away from the diaphragm 21. An inner side of the second auxiliary diaphragm extension portion 2325 is attached and fixed to an outer side of the fixing ring fixing portion 252. A side of the second auxiliary diaphragm extension portion 2325 close to the diaphragm 21 abuts against and is fixed to a side of the fixing ring body 251 away from the diaphragm 21. The suspension supporting portions 2133 are fixed to a side of the elastic member 231 away from the fixing ring 25. The fixing ring 25 fixes the elastic member 231 and the auxiliary diaphragm 232 into an integral structure. With this structure, the elastic support assembly 23 of the speaker device 100 reduces a lateral vibration amplitude of the voice coil 22 so as to enhance the stability of the vibration unit 2 to deal with the dropping of the speaker device 100; and the elastic member 231 also serves to provide an electrical signal for a lead wire of the voice coil 22 so as to avoid the use of a lead wire structure to introduce the electrical signal to the voice coil 22, thereby reducing a lateral vibration amplitude of the voice coil 22, and due to being spaced apart from the auxiliary diaphragm 232, a risk of wire breakage is avoided, and the reliability of the speaker device 100 is improved. In addition, as the elastic member 231 and the auxiliary diaphragm 232 are not in direct contact, when the speaker device 100 is energized, the heat generated by the current passing through the elastic member 231 will not be directly conducted to the auxiliary diaphragm 232, so that the auxiliary diaphragm 232 will not be thermally deformed, thereby maintaining the vibration consistency of the auxiliary diaphragm 232, and thus improving the reliability of the speaker device 100.

One end of the holder 24 extends into the magnetic gap 30 and is fixed to and connected to the voice coil 22, and anther end of the holder 24 extends toward the elastic support assembly 23 and is fixed to and connected to the elastic support assembly 23. Specifically, the holder 24 includes a ring-shaped holder body 241, a first holder fixing portion 242 bending and extending from an inner peripheral side of the holder body 241 toward the voice coil 22, and a second holder fixing portion 243 bending and extending from an outer peripheral side of the holder body 241 toward the elastic support assembly 23.

The holder body 241 is fixed to the suspension body 211. Specifically, the holder body 241 is fixed to a side of the vibrating portion 2113 close to the magnetic circuit unit 3. The first holder fixing portion 242 is fixed to and connected to the voice coil 22.

The first auxiliary diaphragm fixing portion 2322 is fixed to the second holder fixing portion 243, and the first auxiliary diaphragm extension portion 2323 is fixed to a side of the second holder fixing portion 243 close to the frame 1.

In this implementation, the second holder fixing portion 243 is provided with a holder hole 240 penetrating the second holder fixing portion 243. The second fixing arm 2312 passes through the holder hole 240 to be fixed to the second holder fixing portion 243. With this structure, the height of the elastic member 231 fixed to the holder 24 is adjustable, such that the elastic member 231 maintains a distance from the auxiliary diaphragm 232, thereby improving the reliability of the speaker device 100.

Along a vibrating direction of the diaphragm 21, one end of the holder 24 is fixed to the diaphragm 21, and another end of the holder 24 is fixed to the elastic support assembly 23.

The magnetic circuit unit 3 includes a yoke 31 fixed to the bottom wall 11, a main magnet 32 fixed to the yoke 31, and an auxiliary magnet 33 surrounding the main magnet 32 and spaced apart from the main magnet to form a magnetic gap 30.

Compared with the related art, in the present disclosure, the frame is made of a metal material, the fixing ring is a metal ring, and the fixing ring is fixed to the side wall by welding and thus fixes the elastic support assembly to the frame. With this simple structure, the elastic support assembly and the fixing ring can easily be fixed to the frame. There is no need to separately design a structural support feature on the fixing ring or the frame to add a part or process step, which simplifies the assembly process of the speaker device.

In addition, the elastic support assembly, the fixing ring and the frame of the speaker device form a firm overall structure. This structure enhances the stability of the vibration unit to deal with the dropping of the speaker device, thereby improving the overall strength and reliability of the speaker device.

The above described are merely implementations of the present disclosure. It should be noted here that those of ordinary skill in the art may make improvements without departing from the concept of the present disclosure, but such improvements should fall within the protection scope of the present disclosure.

What is claimed is:

1. A speaker device, comprising:

a frame;

a vibration unit fixed to the frame; and a magnetic circuit unit driving the vibration unit to vibrate and produce sound and comprising a magnetic gap, wherein the vibration unit comprises a diaphragm fixed to the frame, a voice coil inserted into the magnetic gap to drive the diaphragm to vibrate and produce sound and at least one elastic support assembly opposite to and spaced apart from the diaphragm and connected to the voice coil; and the at least one elastic support assembly surrounds an outer side of the magnetic circuit unit and is spaced apart from the magnetic circuit unit;

the frame comprises a bottom wall and a side wall bending and extending from a periphery of the bottom wall of the frame, and an outer periphery of the diaphragm is fixed to the side wall of the frame;

the vibration unit further comprises a fixing ring configured to fix the at least one elastic support assembly to the frame, and the fixing ring surrounds the magnetic circuit unit; and the frame is made of a metal material, and the fixing ring is a metal ring fixed to the side wall of the frame by welding, the side wall of the frame comprises a first side wall connected to the bottom wall of the frame and an extension wall having a ring shape and stacked on the first side wall; the outer periphery of the diaphragm is fixed to an inner peripheral side of the extension wall; and the fixing ring is fixed to the extension wall by welding.

2. The speaker device as described in claim 1, wherein the diaphragm comprises a diaphragm fixing portion fixed to the magnetic circuit unit, a dome surrounding the diaphragm fixing portion, and a suspension surrounding the dome; an inner peripheral side of the dome is fixed to a side of the diaphragm fixing portion close to the suspension, and an outer peripheral side of the dome is fixed to a side of the suspension close to the diaphragm fixing portion; the suspension comprises a suspension body fixed to the outer peripheral side of the dome, a suspension fixing portion bending and extending from an outer peripheral side of the suspension body toward the inner peripheral side of the extension wall, and suspension supporting portions extending from the suspension fixing portion toward the at least one elastic support assembly along the inner peripheral side of the extension wall; and the suspension fixing portion and the suspension supporting portions are fixed to the inner peripheral side of the extension wall.

3. The speaker device as described in claim 1, wherein the voice coil has a rectangular structure; the at least one elastic support assembly comprises two elastic support assemblies, and the two elastic support assemblies are spaced apart from each other and located at two opposite sides of the voice coil; and welding positions of the fixing ring and the extension wall are located between the two elastic support assemblies.

4. The speaker device as described in claim 3, wherein the two elastic support assemblies are respectively located at two opposite sides of a short axis of the voice coil; and the welding positions of the fixing ring and the extension wall are respectively located at two opposite sides of a long axis of the voice coil.

5. The speaker device as described in claim 1, wherein one of the at least one elastic support assembly comprises an elastic member opposite to and spaced apart from the diaphragm, and an auxiliary diaphragm provided at a side of the elastic member away from the diaphragm; a side of the elastic member close to the frame is attached to a side of the fixing ring away from the diaphragm, and a side of the elastic member away from the frame is connected to the voice coil; a side of the auxiliary diaphragm close to the frame is attached to a side of the fixing ring away from the diaphragm, and a side of the auxiliary diaphragm away from the frame is connected to the voice coil; and the side of the elastic member away from the frame and the side of the auxiliary diaphragm away from the frame are spaced apart from each other.

6. The speaker device as described in claim 2, wherein the suspension fixing portion has a rectangular structure with rounded corners; the suspension fixing portion comprises four straight sides and four round corners, each of which connects respective two adjacent straight sides of the four straight sides; and the suspension supporting portions are located at positions of the four rounded corners and fixed to the extension wall by gluing.

7. The speaker device as described in claim 5, wherein the vibration unit further comprises a holder fixed to the diaphragm; and the holder comprises an end extending into the magnetic gap and fixed to and connected to the voice coil, and another end extending toward the at least one elastic support assembly and fixed to and connected to the at least one elastic support assembly.

8. The speaker device as described in claim 7, wherein the fixing ring comprises a fixing ring body having a ring shape, and a fixing ring fixing portion bending and extending from an inner peripheral side of the fixing ring body in a direction away from the diaphragm; the fixing ring body is fixed to the extension wall by welding; and the fixing ring fixing portion is fixed to the auxiliary diaphragm;

the auxiliary diaphragm comprises an auxiliary diaphragm suspension, a first auxiliary diaphragm fixing portion bending and extending from an inner side of the auxiliary diaphragm suspension toward the magnetic circuit unit, a first auxiliary diaphragm extension portion extending from the first auxiliary diaphragm fixing portion toward the diaphragm, a second auxiliary diaphragm fixing portion bending and extending from an outer side of the auxiliary diaphragm suspension toward the frame, and a second auxiliary diaphragm extension portion extending from the second auxiliary diaphragm fixing portion toward the diaphragm;

the first auxiliary diaphragm fixing portion is fixed to an end of the holder away from the diaphragm, and the first auxiliary diaphragm extension portion is attached and fixed to a side of the holder close to the frame;

the second auxiliary diaphragm fixing portion is fixed to a side of the fixing ring fixing portion away from the diaphragm; an inner side of the second auxiliary diaphragm extension portion is attached and fixed to an outer side of the fixing ring fixing portion; and a side of the second auxiliary diaphragm extension portion close to the diaphragm abuts against and is fixed to a side of the fixing ring body away from the diaphragm; and the elastic members comprises a first fixing arm fixed to a side of the fixing ring body close to the diaphragm, a second fixing arm fixed to the holder, and an elastic arm connecting the first fixing arm and the second fixing arm; and the second fixing arm is spaced apart from the auxiliary diaphragm.

9. The speaker device as described in claim 8, wherein the holder comprises a holder body having a ring shape, a first holder fixing portion bending and extending from an inner peripheral side of the holder body toward the voice coil, and a second holder fixing portion bending and extending from an outer peripheral side of the holder body toward the at least one elastic support assembly;

the holder body is fixed to the suspension body; and the first holder fixing portion is fixed to and connected to the voice coil; and the first auxiliary diaphragm fixing portion is fixed to the second holder fixing portion, and the first auxiliary diaphragm extension portion is fixed to a side of the second holder fixing portion close to the frame; the second holder fixing portion comprises a holder hole; and the second fixing arm passes through the holder hole to be fixed to the second holder fixing portion.

* * * * *